US012404077B2

(12) United States Patent
Matthews et al.

(10) Patent No.: US 12,404,077 B2
(45) Date of Patent: Sep. 2, 2025

(54) FLEXIBLE ENCLOSURE HAVING A SEAL AND METHOD AND SYSTEM FOR MAKING THE SAME

(71) Applicant: Illinois Tool Works Inc., Glenview, IL (US)

(72) Inventors: Dave Matthews, Gilman, IL (US); Matt Nysted, Kennesaw, GA (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 535 days.

(21) Appl. No.: 17/186,076

(22) Filed: Feb. 26, 2021

(65) Prior Publication Data

US 2021/0269196 A1 Sep. 2, 2021

Related U.S. Application Data

(60) Provisional application No. 62/983,892, filed on Mar. 2, 2020.

(51) Int. Cl.

| | |
|---|---|
| ***B65D 33/25*** | (2006.01) |
| ***B65D 30/20*** | (2006.01) |
| ***B65D 75/58*** | (2006.01) |

(52) U.S. Cl.

CPC ..... *B65D 33/2508* (2013.01); *B65D 31/10* (2013.01); *B65D 75/5827* (2013.01); *B65D 75/5861* (2013.01)

(58) Field of Classification Search

CPC ..... B65D 33/2508; B65D 31/10; B65D 75/5827; B65D 75/5861

USPC ..... 383/42

See application file for complete search history.

(56) References Cited

U.S. PATENT DOCUMENTS

| | | | |
|---|---|---|---|
| 6,971,794 | B2 | 12/2005 | Yeager |
| 7,442,156 | B2 | 10/2008 | Yeager |
| 8,182,407 | B2 | 5/2012 | Yeager |
| 9,962,898 | B1 | 5/2018 | Russell et al. |

(Continued)

FOREIGN PATENT DOCUMENTS

| | | | |
|---|---|---|---|
| DE | 20115181 U1 * | 1/2002 | ..... B65D 31/10 |
| EP | 187308 A1 | 1/2008 | |

(Continued)

OTHER PUBLICATIONS

Machine translation of FR-2816597-A1.*

(Continued)

*Primary Examiner* — Jes F Pascua

(74) *Attorney, Agent, or Firm* — The Small Patent Law Group LLC; Christopher R. Carroll

(57) ABSTRACT

Flexible enclosure includes a front wall and a back wall that oppose each other and a side wall that joins the front and back walls. The front wall, the back wall, and the side wall are discrete sections. The front wall and the back wall are attached to opposite edges of the side wall. The side wall is configured to have a slit between top and bottom wall portions of the side wall. The flexible enclosure also includes a resealer extending between the front and back walls along the bottom wall portion of the side wall. The bottom wall portion is separable from the top wall portion along the slit. The bottom wall portion is configured to flex outwardly and away from the top wall portion and form a spout of the flexible enclosure. The resealer is configured to close the spout.

20 Claims, 8 Drawing Sheets

(56) References Cited

U.S. PATENT DOCUMENTS

| | | | | |
|---|---|---|---|---|
| 2004/0208402 | A1* | 10/2004 | Yeager | B65D 75/5822 383/120 |
| 2007/0086683 | A1 | 4/2007 | Yeager | |
| 2007/0258665 | A1* | 11/2007 | Greco | B65D 33/2508 383/63 |
| 2008/0008404 | A1* | 1/2008 | Brauer | B65D 33/2508 383/61.1 |
| 2008/0008406 | A1* | 1/2008 | Russell | B65D 75/5866 383/63 |
| 2013/0071047 | A1* | 3/2013 | VanLoocke | B65D 33/16 53/469 |
| 2017/0057192 | A1 | 3/2017 | Romenesko | |

FOREIGN PATENT DOCUMENTS

| | | | | |
|---|---|---|---|---|
| EP | 1873081 | A1 * | 1/2008 | B31B 19/36 |
| EP | 2535287 | A1 * | 12/2012 | B65D 33/24 |
| EP | 3715101 | A1 * | 9/2020 | B31B 70/8132 |
| FR | 2816597 | A1 * | 5/2002 | B65D 75/5816 |

OTHER PUBLICATIONS

Machine translation of DE-20115181-U1.*
Machine translation of EP-1873081-A1.*
Machine translation of EP-2535287-A1.*
Search Report for corresponding European Patent Application No. 21159872.7 mailed Jul. 6, 2021 (7 pages).
EPO Exam Report dated Oct. 16, 2024 for corresponding European Patent Application No. 21159872.7 (7 pages).

* cited by examiner

FLEXIBLE ENCLOSURE HAVING A SEAL AND METHOD AND SYSTEM FOR MAKING THE SAME

CROSS-REFERENCE TO RELATED APPLICATION

The present application claims the benefit of U.S. Provisional Application No. 62/983,892, filed on 2 Mar. 2020, which is incorporated herein by reference in its entirety.

FIELD

The subject matter of the present application relates to flexible, resealable enclosures and methods of manufacturing the same.

BACKGROUND

Flexible enclosures (e.g., box lines, plastic packages, and the like) can be used to hold a wide variety of contents. Flexible enclosures have become more popular because such enclosures can cost less than alternatives and can be readily opened but also sealed to provide sufficient protection of the contents therein. A resealable enclosure enables a user to repeatedly open the enclosure, remove a portion of the contents from the enclosure, and then close the enclosure in a manner that seals the contents therein. In many cases, these resealable enclosures are torn or ripped when initially opened. Despite being irreparably altered, the resealable enclosures are configured to reseal the opening to protect the contents from the surrounding environment and/or prevent the contents from inadvertently exiting the enclosure. Compared to user-improvised methods (e.g., rolling the top of a flexible bag), resealable enclosures are tidier and reassure the user that the contents are protected and will not spill if the enclosure is mispositioned or dropped.

One example of a flexible enclosure can form a spout through which the contents may be poured. For example, a corner of a flexible enclosure may be removed that allows a gusseted edge to be pulled outwardly and form a spout. In this design, however, the flexible enclosure is formed from a single section of film. More specifically, a single roll of film may be unwound so that opposite longitudinal edges of the film extend parallel to a central axis. A section of the film may be cut transversely with respect to the central axis, thereby forming a bottom transverse edge that is opposite a top transverse edge of the section. The section may be wrapped around the central axis so that the longitudinal edges overlap themselves and the section forms opposite rounded sides. These rounded sides are pushed inward to form gusseted sides. The top transverse edge may be sealed to itself and the bottom transverse edge may be sealed to itself.

Although one of the gusseted sides is capable of forming the spout, the single section of film limits modifications to the design. Alternative designs are desired.

BRIEF DESCRIPTION

In an embodiment, a flexible enclosure is provided that includes a front wall and a back wall that oppose each other and a side wall that joins the front and back walls. The front wall, the back wall, and the side wall are discrete sections. The front wall and the back wall are attached to opposite edges of the side wall. The side wall is configured to have a slit between top and bottom wall portions of the side wall.

The flexible enclosure also includes a resealer extending between the front and back walls along the bottom wall portion of the side wall. The bottom wall portion is separable from the top wall portion along the slit. The bottom wall portion is configured to flex outwardly and away from the top wall portion and form a spout of the flexible enclosure. The resealer is configured to close the spout.

Optionally, the side wall is configured to have a line of weakness, the slit being formed when the line of weakness is broken.

Optionally, the side wall is a gusseted side wall.

Optionally, the resealer includes a self-mating strip extending between the front and back walls along an interior surface of the side wall. The self-mating strip may have opposite crushed ends and each edge of the side wall may have one of the crushed ends.

Optionally, the resealer includes first and second segments that are configured to mate with one another to close the spout.

Optionally, the side wall is a first side wall and the flexible enclosure includes a second side wall that is also a discrete section with respect to the front wall, the back wall, and the first side wall. The front wall and the back wall are attached to opposite edges of the second side wall, and the first and second side walls oppose each other.

Optionally, the resealer is a first resealer and the second side wall has a second resealer that extends between the front and back walls. The second side wall is configured to have a slit between top and bottom wall portions of the second side wall, wherein the second resealer extends between the front and back walls along the bottom wall portion of the second side wall. The bottom wall portion of the second side wall is separable from the top wall portion along the slit. The bottom wall portion of the second side wall is configured to flex outwardly and away from the top wall portion. The resealer of the second side wall is configured to close the second side wall.

Optionally, the front and back walls have respective slits and respective resealers. The slits of the first and second side walls and the front and back walls enable a user to remove a top of the flexible enclosure to provide an open-ended enclosure having an open top. The resealers of the first and second side walls and the front and back walls enable a user to close the open top of the open-ended enclosure.

Optionally, the resealer is one of four resealers. Each of the resealers extends along a respective one of the first side wall, the second side wall, the front wall, and the back wall.

In an embodiment, a method is provided that includes providing a first continuous web of flexible material moving in a first flow direction. The first continuous web has spaced-apart fastener strips that extend transverse to the first flow direction. The method also includes separating a first segment from the first continuous web and folding the first segment such that at least one of the fastener strips is folded over itself, thereby forming a folded segment. The method also includes providing second and third continuous webs of flexible material that includes second and third segments, respectively. The method also includes coupling the second and third segments to each other and to opposite edges of the folded segment, thereby at least partially forming a flexible enclosure that includes a front wall, a back wall, and a side wall formed by the folded segment. The front and back walls are coupled by the side wall with the fastener strip extending between the front and back walls.

Optionally, the side wall is configured to have a slit between top and bottom wall portions of the side wall. The slit permits the bottom wall portion to flex outwardly and away from the top wall portion and form a spout of the flexible enclosure. The fastener strip is configured to close the spout.

Optionally, providing the first continuous web of flexible material includes the first continuous web having spaced apart lines of weakness that extend transverse to the first flow direction. The lines of weaknesses extend along and operably near respective ones of the fastener strips, wherein the top and bottom wall portions are separable when the line of weakness is broken.

Optionally, the side wall is a gusseted side wall.

Optionally, the fastener strip of the side wall extends along an interior surface of the side wall.

Optionally, the fastener strips extend along at most half of a width of the first continuous web.

Optionally, the fastener strips extend essentially across an entire width of the first continuous web.

Optionally, at least one of the second or third continuous webs has a continuous fastener strip that extends parallel to a flow direction of the at least one second or third continuous webs.

In an embodiment, a system is provided that includes a first actuator configured to unwind a first continuous web of flexible material. The first continuous web moves in a first flow direction. The system also includes a zipper applicator configured to apply fastener strips to the first continuous web. The fastener strips extend transverse to the first flow direction. The system also includes a contoured surface configured to fold the flexible material of the first continuous web such that at least one of the fastener strips is folded over itself. The system also includes a cutter configured to separate a folded first segment from the first continuous web and at least one actuator configured to unwind second and third continuous webs of flexible material that include second and third segments, respectively. The system also includes a heat-sealing assembly configured to couple the second and third segments to each other and to opposite edges of the folded first segment, thereby at least partially forming a flexible enclosure that includes a front wall, a back wall, and a side wall formed by the folded segment. The front and back walls are coupled by the side wall with the fastener strip extending between the front and back walls.

Optionally, the cutter is configured to separate another segment from the first continuous web, the other segment forming a second side wall of the flexible enclosure.

In an embodiment, a flexible enclosure is provided that includes a first wall and a second wall that oppose each other and a side wall that joins the first and second walls. The first wall, the second wall, and the side wall are discrete sections. The first wall and the second wall are attached to opposite edges of the side wall. At least one of the first wall, the second wall, or the side wall is configured to have a slit that separates top and bottom wall portions. The flexible enclosure also includes a seal extending along the slit of the at least one first wall, second wall, or side wall and coupling the top and bottom wall portions. The bottom wall portion is separable from the top wall portion along the seal. The bottom wall portion is configured to flex outwardly and away from the top wall portion.

Optionally, the at least one first wall, second wall, or side wall is configured to have a line of weakness. The slit is formed when the line of weakness is broken.

Optionally, the seal is a one-time frangible seal that can be opened cohesively or adhesively or is a resealer configured to be sealably closed after opening.

Optionally, the resealer includes a self-mating strip extending between the front and back walls along an interior surface of the side wall.

Optionally, the first wall includes the slit and the seal.

In an embodiment, a method is provided that includes providing a first continuous web of flexible material moving in a first flow direction and separating a first segment from the first continuous web and folding the first segment such that at least a portion of the first segment is folded over itself, thereby forming a folded segment. The method also includes providing second and third continuous webs of flexible material that includes second and third segments, respectively. The second and continuous webs move in first and second flow directions. The method also includes coupling the second and third segments to each other and to opposite edges of the folded segment, thereby at least partially forming a flexible enclosure that includes a front wall, a back wall, and a side wall formed by the folded segment. The first flow direction is transverse to at least one of the first flow direction or the second flow direction. At least one of the first continuous web has spaced-apart fastener strips that extend transverse to the first flow direction, the second continuous web has a continuous fastener strip that extends parallel to the second flow direction, the third continuous web has a continuous fastener strip that extends parallel to the third flow direction.

Optionally, at least two of the following is true: The first continuous web has spaced-apart fastener strips that extend transverse to the first flow direction. The second continuous web has a continuous fastener strip that extends parallel to the second flow direction. The third continuous web has a continuous fastener strip that extends parallel to the third flow direction.

Optionally, the first continuous web has spaced-apart fastener strips that extend transverse to the first flow direction, the second continuous web has a continuous fastener strip that extends parallel to the second flow direction, and the third continuous web has a continuous fastener strip that extends parallel to the third flow direction.

Optionally, the spaced-apart fastener strips and/or the continuous fastener strip are one-time frangible seals that can be opened cohesively or adhesively or are resealers configured to be sealably closed after opening.

In an embodiment, a system is provided that includes a first actuator configured to unwind a first continuous web of flexible material. The first continuous web moves in a first flow direction. The system also includes a second actuator configured to unwind a second continuous web of flexible material. The second continuous web moves in a second flow direction. The system also includes a third actuator configured to unwind a third continuous web of flexible material. The third continuous web moves in a third flow direction. The system also includes at least one zipper applicator configured to apply a fastener strip to at least one of the first continuous web, the second continuous web, or the third continuous web. The system also includes a contoured surface configured to fold the flexible material of the first continuous web such that at least a portion of a first segment is folded over itself, thereby forming a folded segment. The system also includes a cutter configured to separate the folded segment from the first continuous web. The first flow direction is transverse to at least one of the first flow direction or the second flow direction. The at least one zipper applicator at least one of applies spaced-apart fastener strips to the first continuous web that extend transverse to the first flow direction, applies a continuous fastener strip to the second continuous web that extends parallel to the second flow direction, or applies a continuous fastener strip to the third continuous web that extends parallel to the third flow direction.

Optionally, at least two of the following are true. The at least one zipper applicator applies spaced-apart fastener strips to the first continuous web that extend transverse to the first flow direction. The at least one zipper applicator applies a continuous fastener strip to the second continuous web that extends parallel to the second flow direction, or the at least one application applies a continuous fastener strip to the third continuous web that extends parallel to the third flow direction.

Optionally, the spaced-apart fastener strips and/or the continuous fastener strip are one-time frangible seals that can be opened cohesively or adhesively or are resealers configured to be sealably closed after opening.

BRIEF DESCRIPTION OF THE DRAWINGS

The inventive subject matter will now be illustrated with reference to the following figures, in which.

DETAILED DESCRIPTION

Figure 1:
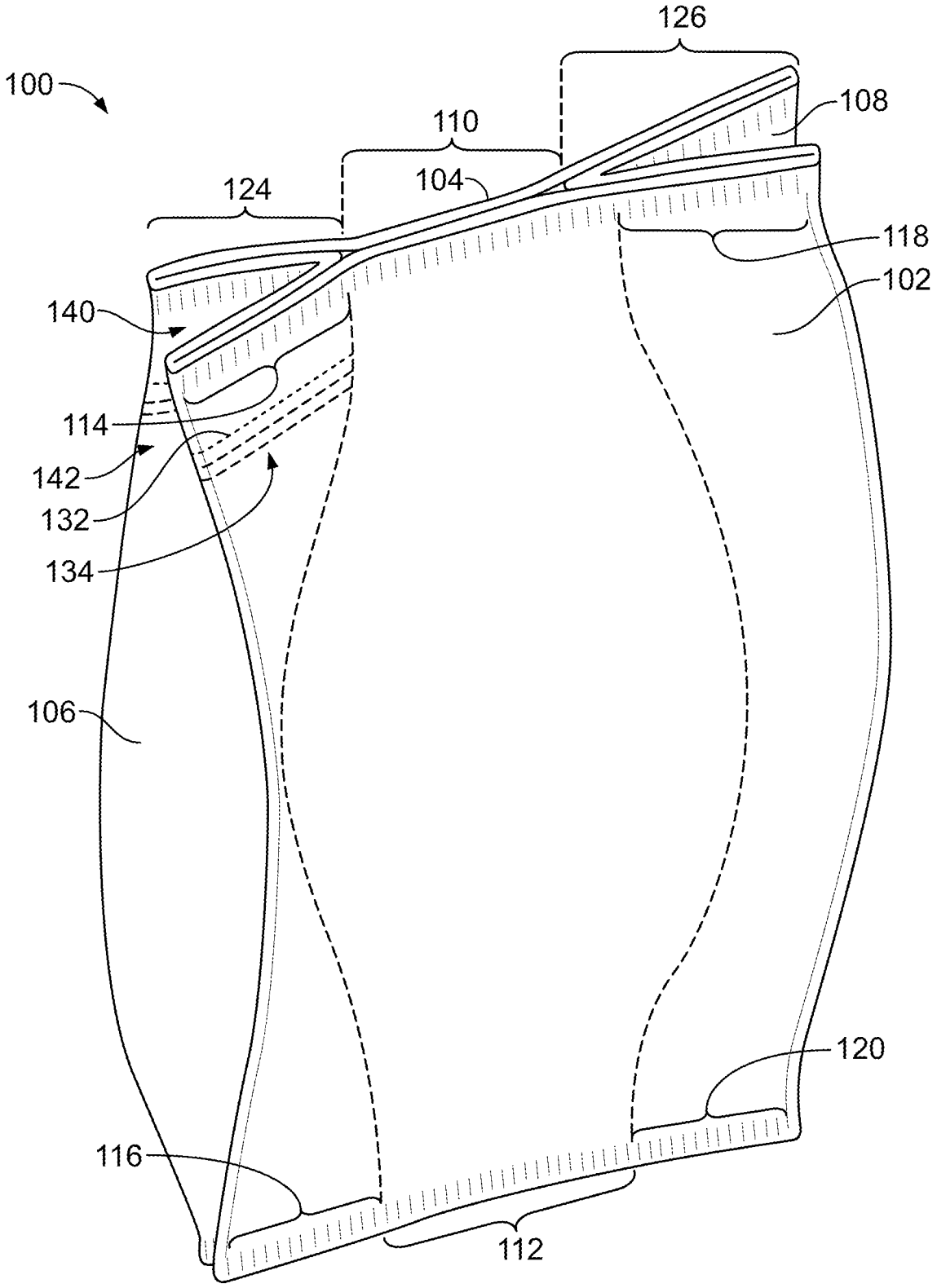
FIG. 1 is an isolated perspective view of a flexible enclosure formed in accordance with an embodiment.

One or more embodiments of the inventive subject matter set forth herein include a resealable flexible enclosure and methods of making the same. The flexible enclosure can include at least two discrete sections or segments that form walls of the flexible enclosure. An access opening can be formed, through which contents (e.g., product) may pass into or out of the flexible enclosure. For example, the access opening can be provided by a spout that is formed along one side of the flexible enclosure. Optionally, the access opening can be formed when a top portion of the flexible enclosure is removed. The access opening may be sealed and re-sealed. In particular embodiments, the flexible enclosure may be manufactured using a machine such as a Totani pouch-making machine (e.g., BH Series or FD Series machine).

The sections (or segments) that form the flexible enclosure can be discrete because, prior to being attached to each other, the sections are separate from each other. The sections may be provided by at least two different continuous webs of flexible material. For example, a first section (or front wall) and a second section (or back wall) may be essentially rectangular sections having edges. An edge of the first section may be either attached to an edge of the second section (e.g., along a top or bottom of the flexible enclosure) or attached to an edge of the side wall. Likewise, an edge of the second section may be either attached to an edge of the first section (e.g., along a top or bottom of the flexible enclosure) or attached to an edge of the side wall.

In the illustrated embodiment described below, the resealer includes a single self-mating fastener strip. A self-mating fastener strip includes a self-mating zipper strip, an intermeshable closure member, an adhesive reseal or the like. An intermeshable closure member may include a strip of a structured surface having ridges and troughs that can mate with itself. An intermeshable closure member may include two opposing hook-filled strips having the same or similar structure. When brought together, the hooks of one strip may couple to the hooks of the opposing strip, thereby sealing the enclosure. The hooks could be configured to engage on multiple levels. Widths of the intermeshable closure members may be configured so that precise alignment is not required.

In other embodiments, however, the resealer may include two or more fastener strips or other types of resealers. For example, the resealer may include separate but parallel zipper strips, different adhesive strips, hook-and-loop fastener elements, or a slider or a combination thereof. The resealer may include, for example, a track and a strip on opposing surfaces of the enclosure in which the strip fits within and along the track. Optionally, the resealer may include two tracks and two strips in which each track receives one strip.

Optionally, the resealer may include one or more adhesive reseals. The adhesive reseal may comprise a polymeric material, such as at least one of polyethylene (including a polyethylene copolymer), polypropylene, ionomers, amorphous polyester, vinyl acetate, polybutylene, or nylon ethylene-vinyl alcohol copolymer (EVOH). In some embodiments, the adhesive seal may include a material that is capable of being reused to open and close the barrier. In other embodiments, the resealer may be substituted with a one-time frangible seal that can be opened cohesively or adhesively.

In the following description and claims, relative or spatial terms such as "front," "back," "side," "top," "bottom," "lateral," "longitudinal," and the like are only used to distinguish the referenced elements or features with respect to one another and make the language more readily understandable. The terms do not necessarily require particular positions, sizes, or orientations relative to the surrounding environment. Moreover, in the following description and claims, the terms "first," "second," and "third," etc. may be used as labels to distinguish similar elements (e.g., first and second side walls) and are not intended to impose numerical requirements on their objects.

FIG. 1 illustrates a perspective view of a resealable flexible enclosure 100. In the illustrated embodiment, the flexible enclosure 100 includes a front wall (or first wall) 102, a back wall (or second wall) 104, and first and second side walls 106, 108. Although FIG. 1 shows two side walls 106, 108, the flexible enclosure 100 may include only one side wall in other embodiments.

The walls 102, 104, 106, 108 are discrete sections of a flexible material. In some embodiments, the discrete sections may be provided by different webs (or films) of the flexible material. Discrete sections are not portions of the same piece of flexible material. Discrete sections are typically cut from different webs or cut from the same web at different times. For example, the front wall 102 may be obtained from a first continuous web of flexible material, the back wall 104 may be obtained from a different second continuous web of the same flexible material, and the side walls 106, 108 may be obtained from a third continuous web of the same flexible material. In some embodiments, different walls may comprise different types of material. In an alternative embodiment, the different walls may be provided by the same continuous web.

In the illustrated embodiment, the front wall 102 and the back wall 104 are directly attached to each other along a top sealed region 110 and a bottom sealed region 112. The front wall 102 is also directly attached to the first side wall 106 along a top sealed region 114 and a bottom sealed region 116. The front wall 102 is also directly attached to the second side wall 108 along a top sealed region 118 and a bottom sealed region 120. The back wall 104 is also directly attached to the first side wall 106 along a top sealed region 124 and the second side wall 108 along a top sealed region 126. Although not shown, the back wall 104 is also directly attached to the second side wall 108 along a bottom sealed region and the first side wall 106 along a bottom sealed region.

Also shown in FIG. 1, the first side wall 106 includes a line of weakness 132 and a resealer 134. In the illustrated embodiment, the first and second side walls 106, 108 are gusseted side walls such that a portion of the side walls are folded inwardly between the front and back walls 102, 104. In other embodiments, however, the first and second side walls 106, 108 may not be gusseted.

Figure 2:
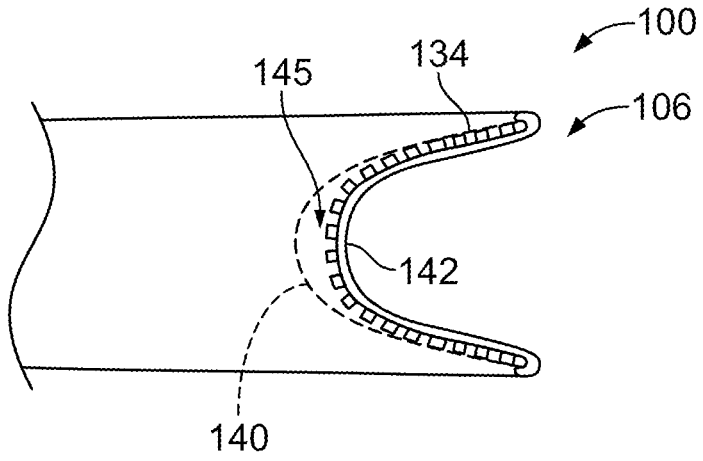
FIG. 2 is a cross-section of the flexible enclosure of FIG. 1 prior to the flexible enclosure being opened.
Figure 3:
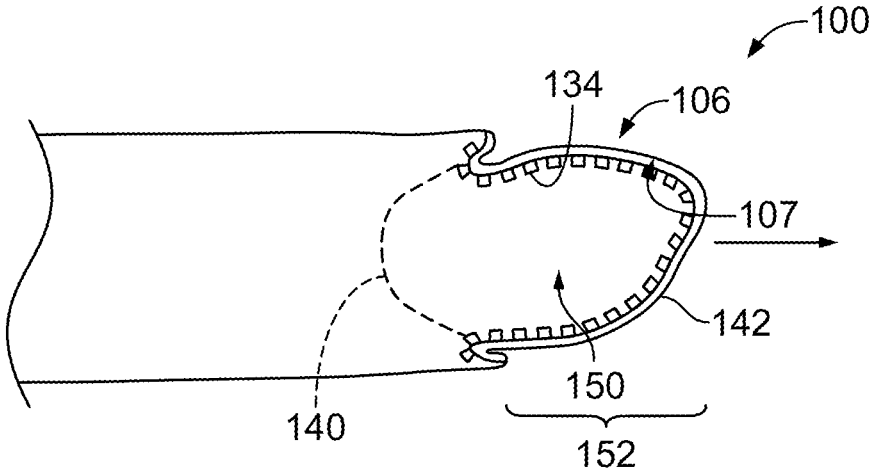
FIG. 3 is a cross-section of the flexible enclosure of FIG. 1 after being opened but prior to being resealed.
Figure 4:
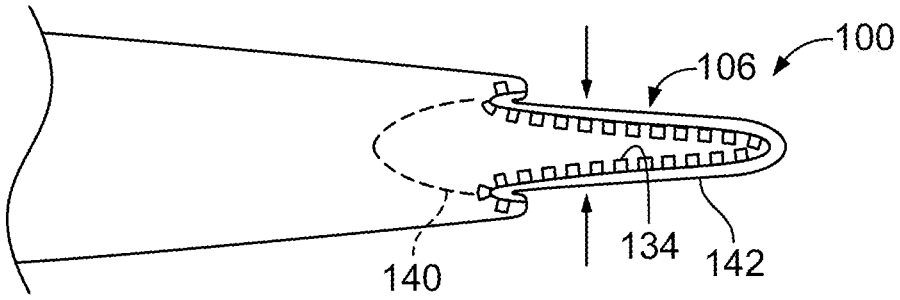
FIG. 4 is a cross-section of the flexible enclosure of FIG. 1 after being resealed.

FIGS. 2-4 illustrate cross-sections of a portion of the flexible enclosure 100. In the illustrated embodiment, the line of weakness 132 (FIG. 1) causes a slit 145 (FIG. 2) to be formed when the line of weakness 132 is ruptured (e.g., by a user's thumb). The slit 145 is positioned between a top wall portion 140 (FIG. 1) and a bottom wall portion 142 of the side wall 106. In FIGS. 2-4, a profile of the top wall portion 140 is shown as a dashed line. The slit 145 becomes an access opening 150 (shown in FIG. 3) when the bottom wall portion 142 is moved outwardly. In the illustrated embodiment, the resealer 134 is a self-mating fastener strip located along an interior surface 107 of the first side wall 106. A self-mating fastener strip includes either (a) only a single segment that is folded onto itself when the access opening 150 is sealed or (b) two segments, having the same profile or structure, that oppose and engage each other when the access opening 150 is sealed. The self-mating fastener strip may be, for example, a self-mating zipper strip or an intermeshable closure member.

In other embodiments, however, the resealer 134 may include other types of fasteners that may or may not be self-mating. For example, in one alternative embodiment, a zipper assembly may permit the side wall to be separated into top and bottom portions, thereby providing an access opening 150, while two zipper strips having different profiles may be positioned along an interior surface of the bottom portion and engage each other.

FIG. 3 illustrates how the first side wall 106 forms a spout 152. The spout 152 corresponds to an increased dimension (or width) of the flexible enclosure 100. When the flexible enclosure 100 includes the spout 152, the width of the flexible enclosure 100 is greater than the width of the flexible enclosure 100 prior to forming the spout 152. To seal or close the access opening 150, sides of the spout 152 that are approximately parallel to the front and back walls 102, 104 are pressed toward each other. As shown in FIG. 4, the side wall 106 remains in an extended or projected form but the resealer 134 closes the access opening 150. In FIG. 4, the profile of the top wall portion 140 is exaggerated inwardly. In other embodiments, the top wall portion 140 may essentially coincide with ends of the resealer 134 such that the access opening 150 is effectively closed.

Accordingly, in some embodiments, a user can open the flexible enclosure 100 by pressing into (e.g., with the user's thumb or index finger) the first side wall 106 to break the line of weakness 132. The line of weakness 132 is between the top and bottom wall portions 140, 142 but may be located closer to the top sealed regions 114, 118, 124, 126 than the bottom sealed regions 116, 120. Once broken, the slit 145 may exist between the top and bottom wall portions 140, 142. The user may then pull the first side wall 106 away from an interior of the flexible enclosure 100. More specifically, the user may grip the interior surface of the bottom wall portion 142 and pull the bottom wall portion 142 outwardly. An access opening 150 develops from the slit 145 as a distance between an edge of the bottom wall portion 142 and an edge of the top wall portion 140 becomes greater. The top wall portion 140 is not moved outwardly. In alternative embodiments, the slit 145 may exist between two opposing zipper strips of a zipper assembly.

With the bottom wall portion 142 projecting outwardly and the top wall portion 140 remaining in position, the spout 152 is formed. Content (e.g., cereal, coffee grounds, cleaning powder, etc.) may be poured from the flexible enclosure 100. To close the access opening 150, opposite portions of the spout 152 are moved toward each other. For example, the user may pinch or squeeze opposing sections of the first side wall 106 that form the spout 152. The resealer 134 located along an interior surface of the first side wall 106 may securely close the access opening 150. For instance, two opposing fastener strips may engage one another. The resealer 134 may be self-mating such that the fastener strips have a common structured surface that is capable of mating with itself. As discussed above, however, the fastener strips may have different structures and be of different types.

Figure 5:
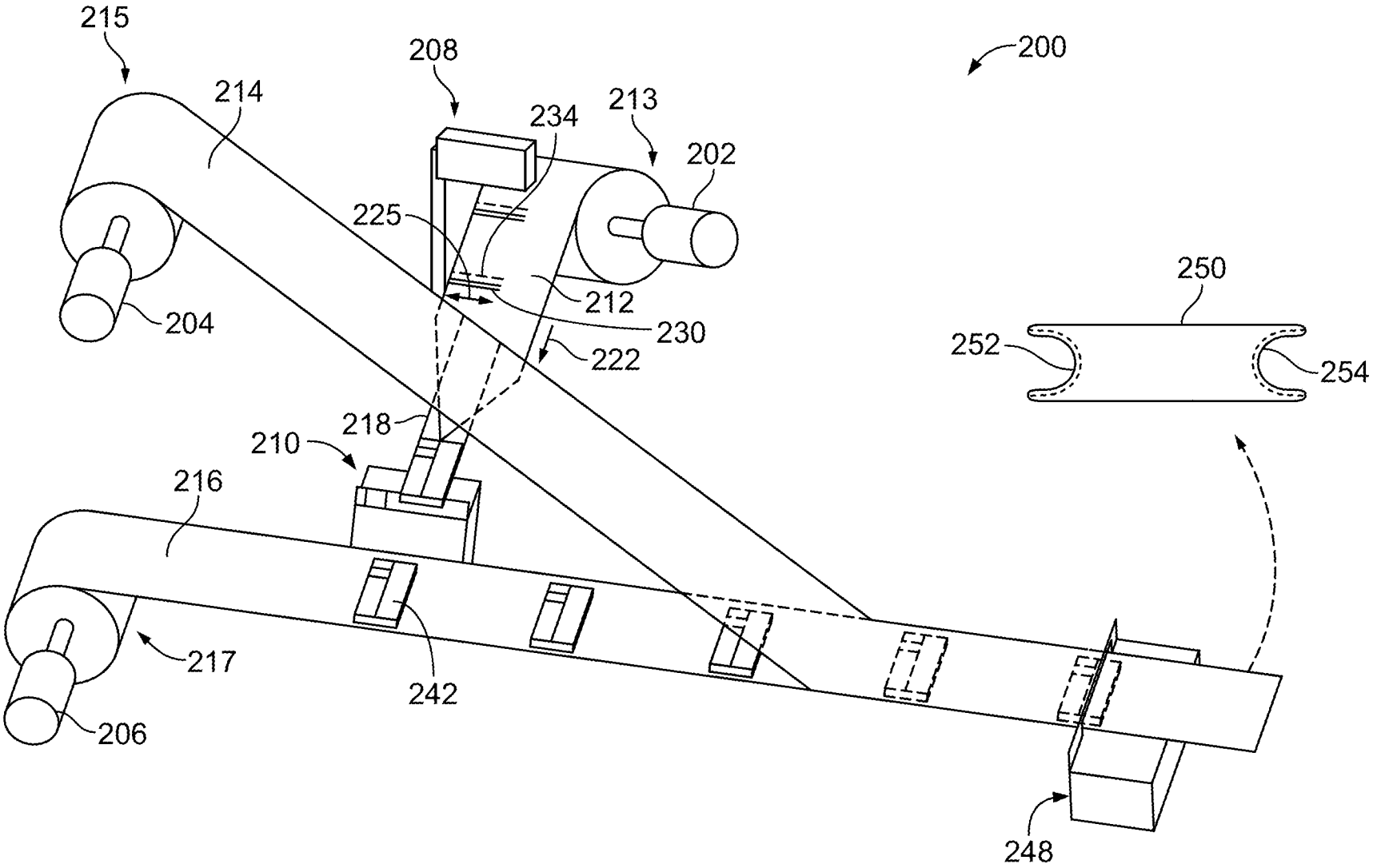
FIG. 5 is a schematic illustration of a system formed in accordance with an embodiment that may be used to make the flexible enclosure of FIG. 1.
Figure 6:
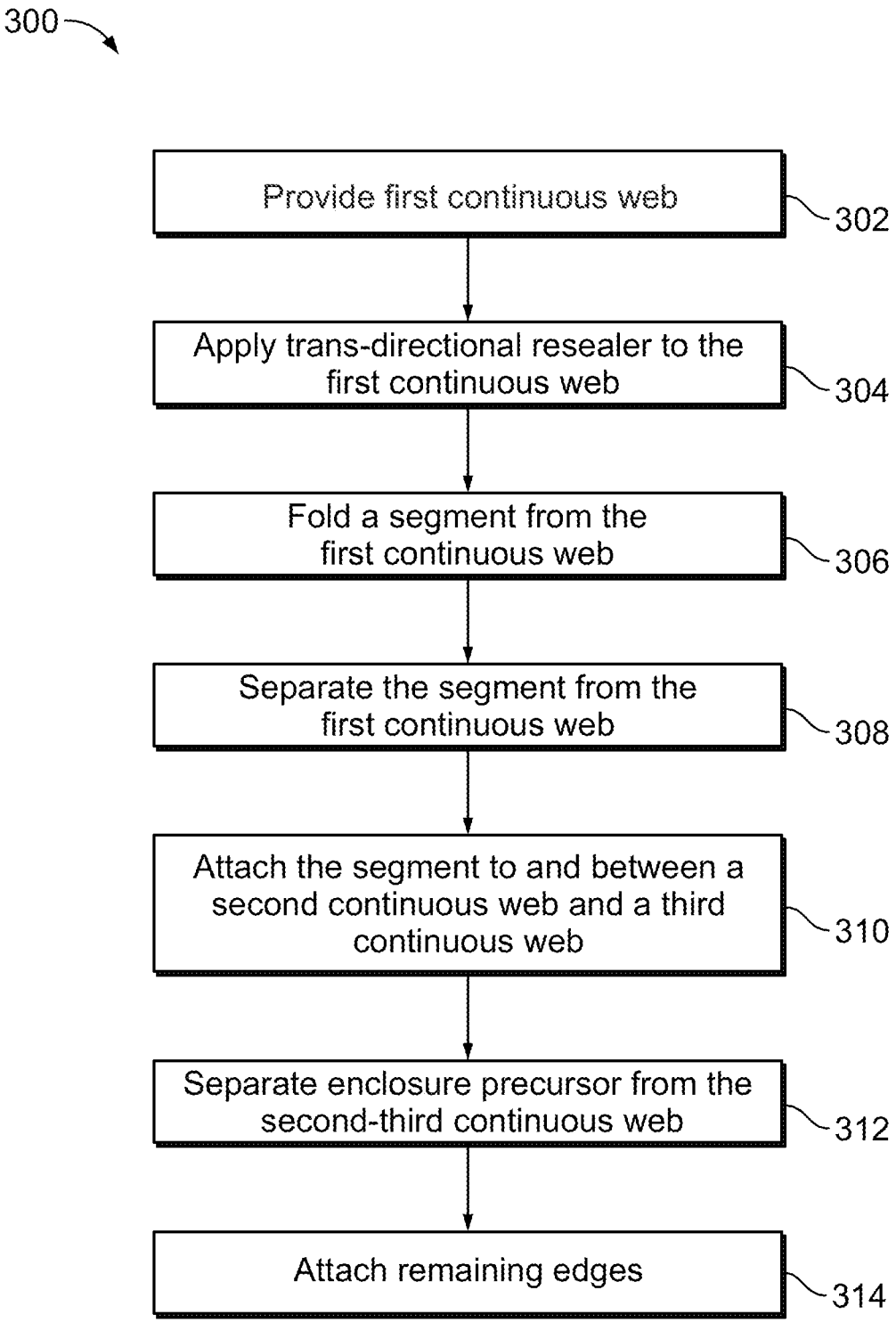
FIG. 6 is a flowchart of a method in accordance with an embodiment.

FIG. 5 is a schematic diagram of a system 200 formed in accordance with an embodiment, and FIG. 6 is a flowchart of a method 300 that may be carried out by the system 200. The system 200 may be used in the manufacturing of a flexible enclosure, such as the flexible enclosure 100 (FIG. 1). It should be noted that the particular arrangement of components (e.g., the number, types, placement, or the like) of the illustrated embodiment may be modified in various alternate embodiments. In various embodiments, different numbers of a given element may be employed, a different type or types of a given element may be employed, a given element may be added, or a given element may be omitted.

The system 200 includes a plurality of actuators that move continuous webs of flexible material. For example, the actuators may include a first actuator 202, a second actuator 204, and a third actuator 206. The actuators may be rotary actuators or servo-motors. As shown in FIG. 5, the first actuator 202 is operably connected to a roll or spool 213 of a first continuous web 212 of flexible material, the second actuator 204 is operably connected to a roll or spool 215 of a second continuous web 214 of flexible material, and the third actuator 206 is operably connected to a roll or spool 217 of a third continuous web 216 of flexible material. The flexible material of each web may comprise a single material or may be a composite material comprising two or more layers of different materials.

The method 300 includes providing, at 302 (FIG. 6), the first continuous web 212 moving in a first flow direction 222. For example, the first actuator 202 may cause the roll 213 of the first continuous web 212 to unwind, thereby moving the first continuous web 212 in the first flow direction 222.

In some embodiments, the first continuous web 212 is provided to a trans-directional (TD) applicator 208. As the continuous web 212 moves in the first flow direction 222, the TD applicator 208 may apply, at 304 (FIG. 6), a resealer 230. In particular embodiments, the resealer 230 includes a fastener strip (e.g., zipper strip). The resealer 230 may extend in a transverse direction 225 that is perpendicular to the first flow direction 222. In some embodiments, a line of weakness and/or slit (generally referred to by 234) may be applied by the TD applicator 208 or by an adjacent system. The line of weakness and/or slit 234 may extend adjacent to and parallel to the resealer 230.

In the illustrated embodiment, the resealer 230 and the line of weakness and/or slit 234 are applied to the first continuous web 212 as the first continuous web 212 to the next manufacturing stage. In other embodiments, at least one of the resealer 230 or the line of weakness and/or slit 234 are pre-applied. For example, the first continuous web 212 may be unwound and the resealer 230 and the line of weakness and/or slit 234 applied. The first continuous web 212 may then be rewound and transported to another location or stored for later use.

At 306 (FIG. 6), a first segment 242 of the first continuous web 212 is folded into a desired shape. At 308 (FIG. 6), the first segment 242 is separated from the first continuous web 212. To fold the first segment 242, one or more surfaces of an apparatus 218 may shape the first segment 242 as the first segment 242 glides along the surface(s) of the apparatus 218. For example, the apparatus 218 may include a funnel-shaped tube that is axially aligned with the first continuous web 212 and the first flow direction 222. As the first continuous web 212 flows through the tube, the surfaces of the tube force the first continuous web 212 into a desired shape. As shown, the folded first segment 242 may have an oval shape or may be C-shaped. For example, opposite edges of the first segment 242 may be adjacent to each other with a small gap therebetween, may essentially contact each other, or may overlap each other.

The first segment 242 may then be removed from the remaining body of the first continuous web 212 using, for example, a cutting machine 210. The cutting machine 210 may mechanically separate (or cut) the flexible material using, for example, a blade. However, other mechanisms may be used to separate the first segment 242 from the remaining body of the first continuous web 212.

In the illustrated embodiment, the first segment 242 is folded and then separated from the first continuous web 212. In other embodiments, the first segment 242 may be separated from the first continuous web 212 and then folded into the desired shape. In some embodiments, the cutting machine 210 and the apparatus 218 may be essentially part of the same machine or sub-system.

At 310 (FIG. 6), the folded first segment is attached to a segment of the second continuous web 214 and a segment of the third continuous web 216. Segments may be attached by sealing portions of two or more segments to each other. For example, the folded first segment 242 may be attached to the second continuous web 214 and the third continuous web 216 through thermal sealing in which thermal energy (heat) and pressure cause a seal to form along the joined segments. A common method of sealing two or more segments to each other is heat-sealing in which heated bars press the segments to each other causing the layers to melt and the two segments to bond or fuse together. Another method of sealing two or more segments to each other may include ultrasonic sealing. Other methods of sealing may include impulse sealing, band sealing, and hot wire sealing.

In some embodiments, top sealed regions, and bottom sealed regions for one side of the flexible enclosure may be formed when the first folded segment 242 and the third continuous web 216 undergo a heat-sealing process. Top sealed regions and bottom sealed regions for the other side of the flexible enclosure may be formed when the first folded segment 242 and the second continuous web 214 undergo a heat-sealing process. These two processes may be performed simultaneously or at different times. In FIG. 5, it appears that the third continuous web 216 and the first folded segment 242 are attached to each other prior to the second continuous web 214 being attached to the first folded segment 242. In other embodiments, the second continuous web 214 may be attached before the third continuous web 216 is attached. Alternatively, the second continuous web 214 and the third continuous web 216 may be concurrently attached to the first folded segment 242.

The first and second continuous webs 214, 216 with one or more first folded segments 242 positioned therebetween may be referred to as a composite web from which precursor enclosures may be obtained. At 312 (FIG. 6), a cutting machine 248 may separate the precursor enclosures from the composite web. FIG. 5 also shows an example cross-section of a precursor enclosure 250. The precursor enclosure 250 includes one section 252 of a first folded segment (segment A) and another section 254 of a different first folded segment (segment B). The section 254 includes a resealer, but the section 252 does not include a resealer. As such, in the illustrated embodiment, the first folded segment 242 is cut in half such that one portion functions as a first side wall for one precursor enclosure and the other portion functions as a second side wall for a subsequent precursor enclosure. At 314 (FIG. 6), other openings may be sealed and the flexible enclosure may be filled with a desired product.

Figure 7:
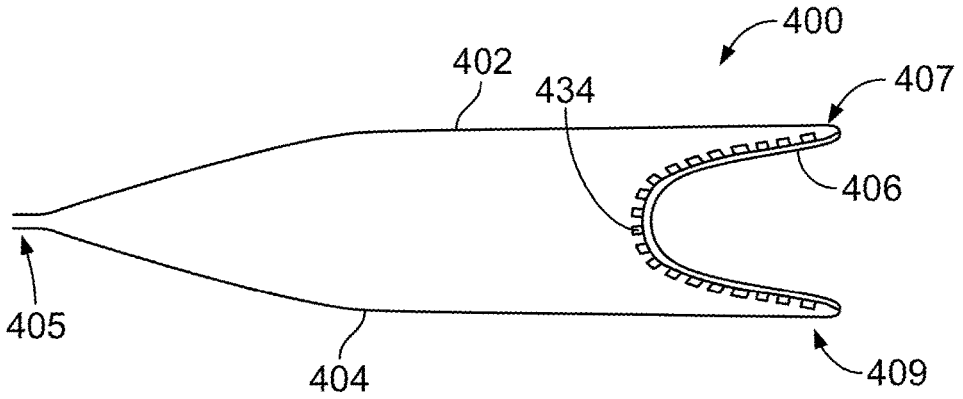
FIG. 7 is a cross-section of a three-sided flexible enclosure in accordance with an embodiment prior to being opened.
Figure 8:
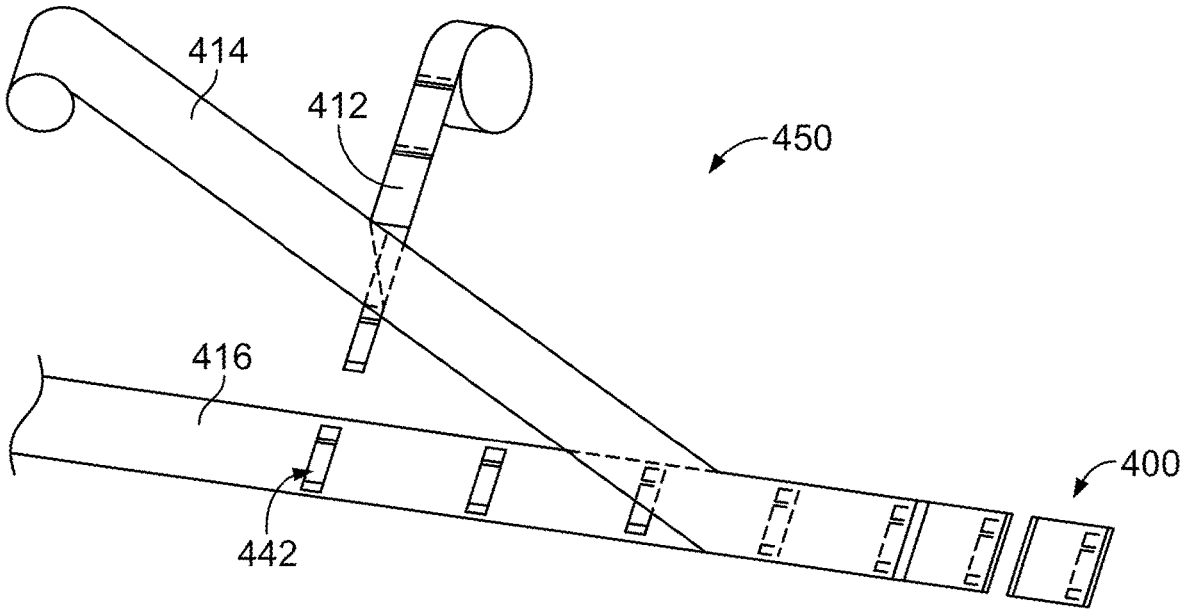
FIG. 8 is a schematic illustration of a system formed in accordance with an embodiment that may be used to make the flexible enclosure of FIG. 7.

FIG. 7 is a cross-section of a three-sided flexible enclosure 400, and FIG. 8 is a schematic illustration of a system 450 that may be used to make the flexible enclosure 400. The flexible enclosure 400 may include elements and features that are similar or identical to the elements and features of the flexible enclosure 100. The system 450 may include elements and features that are similar or identical to the elements and features of the system 200.

The flexible enclosure 400 includes a front wall (or first wall) 402, a back wall (or second wall) 404, and only a single side wall 406. The walls 402, 404, 406 are discrete sections of a flexible material. For example, the front wall 402 may be obtained from a first continuous web 412 (FIG. 8) of flexible material, the back wall 404 may be obtained from a second continuous web 414 (FIG. 8) of flexible material, and the side wall 406 may be obtained from a third continuous web 416 (FIG. 8) of flexible material. As shown in FIG. 7, the front wall 402 and the back wall 404 may be directly attached to each other through a heat-seal 405. The heat-seal 405 forms a side edge of the flexible enclosure 400. The front wall 402 and the back wall 404 may be directly attached to opposite edges of the side wall 406 through heat seals 407, 409.

Also shown, the side wall 406 includes a resealer 434 that is positioned along an interior surface of the side wall 406. Optionally, a line of weakness (not shown) may be provided to permit a user to create a slit along the resealer 434. Similar to the flexible enclosure 100 (FIG. 1), the slit permits a user to pull a bottom portion of the side wall 406 outwardly and form a spout. The resealer 434 may be used to close the spout.

As shown in FIG. 8, the resealer 434 extends transverse to a flow direction of the first continuous web 412. The resealer 434 extends across an entire width of the first continuous web 412. A folded segment 442 of the first continuous web 412 may be folded and separated from the first continuous web 412. The folded segment 442 is C-shaped. Unlike the folded segment 242 (FIG. 5), the folded segment 442 will form only one side of a flexible enclosure. Opposite edges of the folded segment 442 are attached to the second and third continuous webs 414, 416. The second and third continuous webs 414, 416 may then be directly attached to each other along the heat seal 405, which forms the side edge of the flexible enclosure 400. After attaching the second and third continuous webs 414, 416, the composite web may be sliced along the heat seal 405 to separate the flexible enclosure 400 from the composite web.

As shown in FIGS. 7 and 8, the C-shaped side wall 406 is concave such that the side wall 406 is shaped inwardly and has the resealer 434 along an interior surface of the side wall 406. In alternative embodiments, the side wall is C-shaped but convex such that the side wall extends outwardly. The resealer may be positioned along an interior surface of the side wall as described above. In such embodiments, the side wall may be shaped like a spout prior to opening.

Figure 9A:
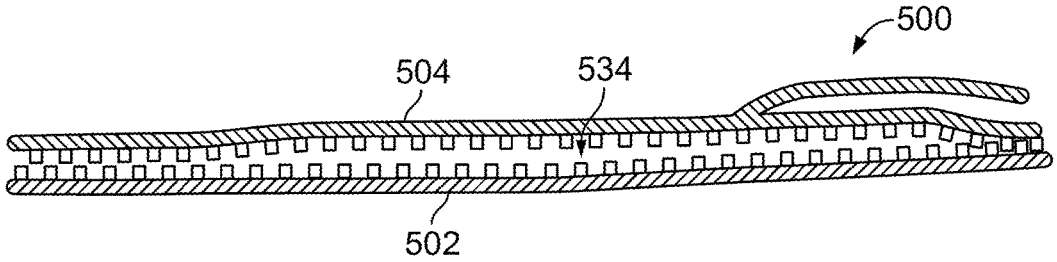
FIG. 9A is a cross-section of a closed three-sided flexible enclosure in accordance with an embodiment having a two-piece resealer.
Figure 9B:
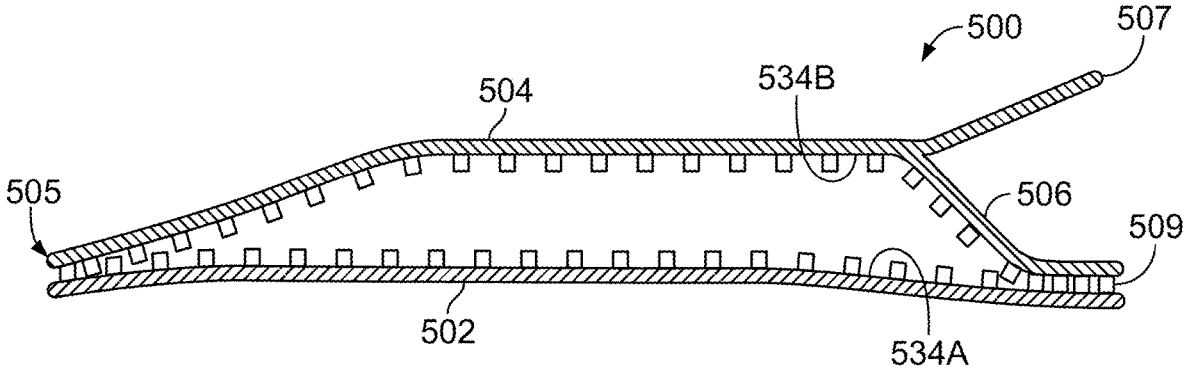
FIG. 9B is a cross-section of an opened three-sided flexible enclosure in accordance with an embodiment having a two-piece resealer.
Figure 10:
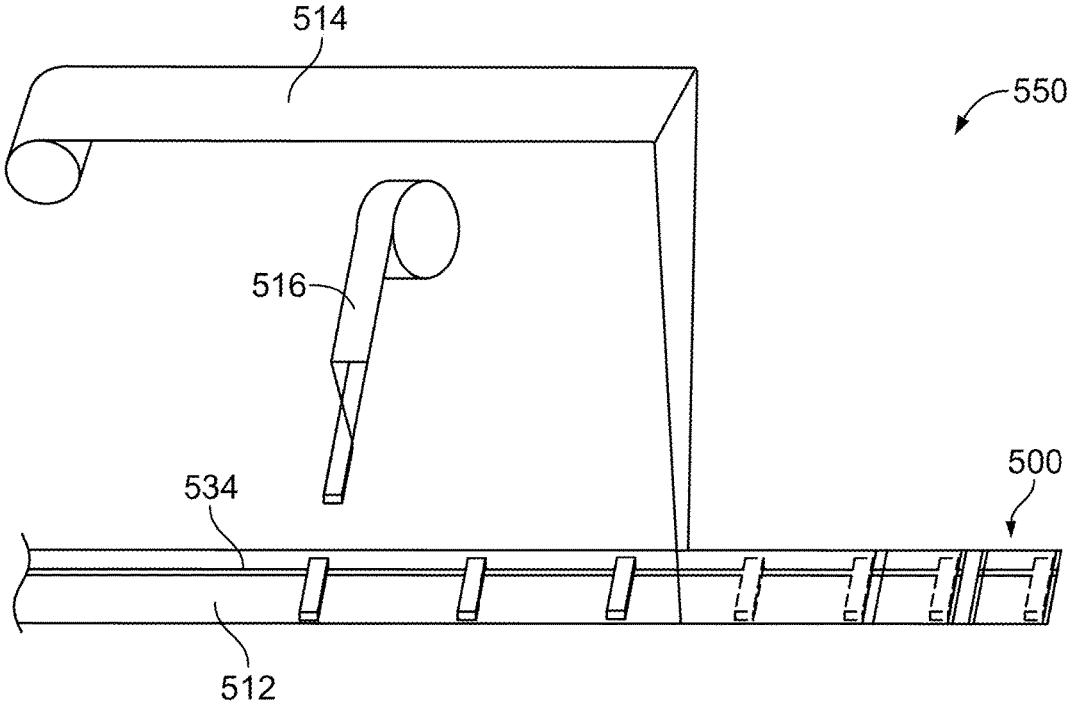
FIG. 10 is a schematic illustration of a system formed in accordance with an embodiment that may be used to make the flexible enclosure of FIGS. 9A and 9B.

FIG. 9A is a cross-section of a closed three-sided flexible enclosure 500, and FIG. 9B is a cross-section of the three-sided flexible enclosure 500 when opened. FIG. 10 is a schematic illustration of a system 550 that may be used to make the flexible enclosure 500. The flexible enclosure 500 may include elements and features that are similar or identical to the elements and features of the other flexible enclosures described herein. The system 550 may include elements and features that are similar or identical to the elements and features of the other systems described herein.

The flexible enclosure 500 includes a first wall (or front wall) 502, a second wall (or back wall) 504, and only a single side wall 506. The walls 502, 504, 506 are discrete sections of a flexible material. For example, the first wall 502 may be obtained from a first continuous web 512 (FIG. 10) of flexible material, the second wall 504 may be obtained from a second continuous web 514 (FIG. 10) of flexible material, and the side wall 506 may be obtained from a third continuous web 516 (FIG. 10) of flexible material. As shown in FIG. 9B, the first wall 502 and the second wall 504 may be directly attached to each other through a heat-seal 505. The heat-seal 505 forms a side edge of the flexible enclosure 500. The first wall 502 and the second wall 504 are directly attached to opposite edges of the side wall 506 through heat seals 507, 509.

Unlike the flexible enclosures 100, 400, which have side walls with resealers, the side wall 506 does not have a resealer. Instead, the first wall 502 has a resealer 534 positioned along an interior surface of the first wall 502. To provide the resealer 534 along the first wall 502, the resealer 534 is applied to the first continuous web 512. More specifically, the resealer 534 is applied in a direction that is parallel to the flow direction of the first continuous web 512. The flexible enclosure 500 may then be manufactured in a manner that is similar to the flexible enclosure 400.

In the illustrated embodiment of FIGS. 9A, 9B, and 10, the first wall 502 is a front wall. In other embodiments, the first wall 520 may be a back wall or, alternatively, the resealer may be applied to the second wall, which may function as a front wall or a back wall.

In some embodiments, the resealer 534 is a two-piece resealer that includes a first segment 534A (FIG. 9B) and a second segment 534B (FIG. 9B) that are configured to mate with each other. For example, the first and second segments 534A, 534B may be zipper segments having male and female interlocking features. The first segment 534A may be coupled to a bottom wall portion of the first wall 502, and the second segment 534B may be coupled to a top wall portion of the first wall 502.

Figure 11:
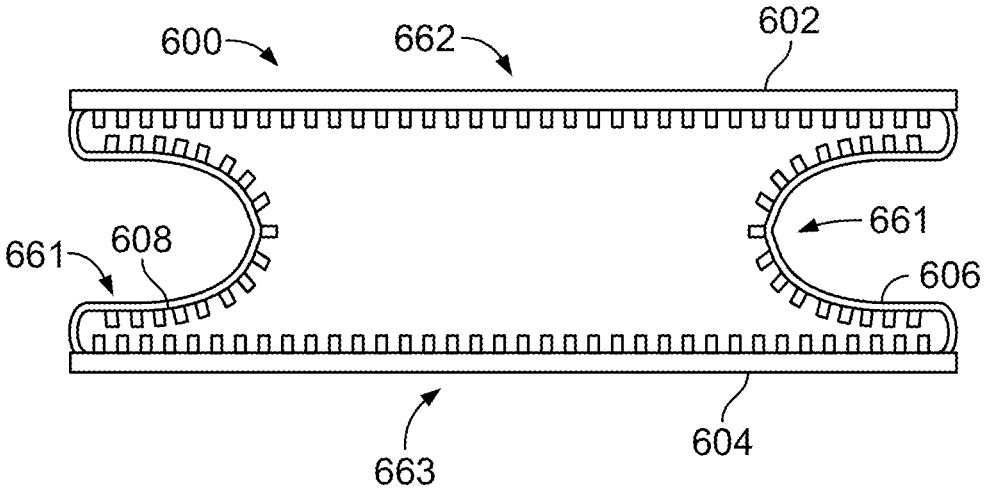
FIG. 11 is a cross-section of a four-sided flexible enclosure in accordance with an embodiment.
Figure 12:
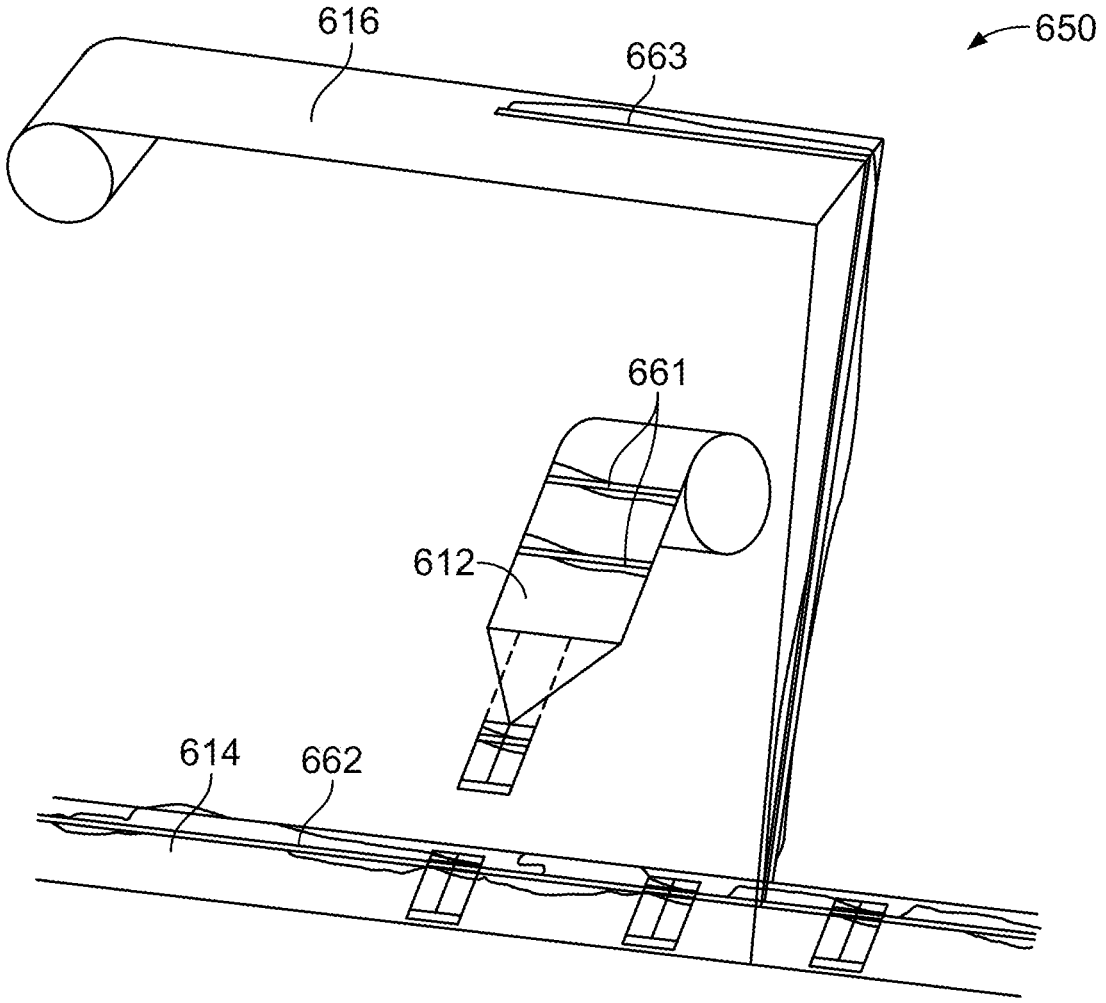
FIG. 12 is a schematic illustration of a system formed in accordance with an embodiment that may be used to make the flexible enclosure of FIG. 11.
Figure 13:
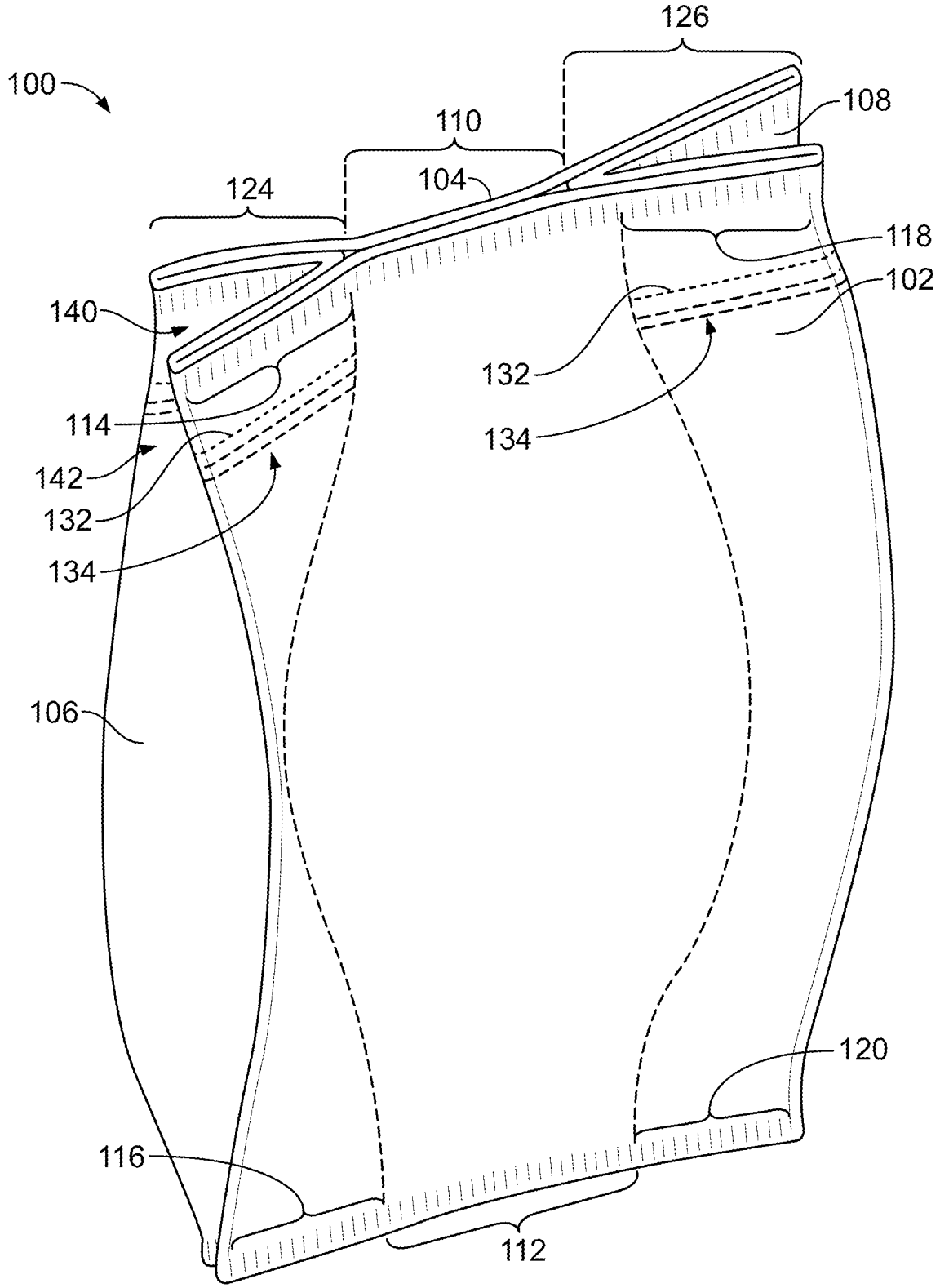
FIG. 13 is an isolated perspective view of a flexible enclosure formed in accordance with an embodiment.

FIG. 11 is a cross-section of a four-sided flexible enclosure 600, and FIG. 12 is a schematic illustration of a system 650 that may be used to make the flexible enclosure 600. The flexible enclosure 600 may include elements and features that are similar or identical to the elements and features of the other flexible enclosures described herein. The system 650 may include elements and features that are similar or identical to the elements and features of the other systems described herein.

The flexible enclosure 600 includes a front wall (or first wall) 602, a back wall (or second wall) 604, and first and second side walls 606, 608. The walls 602, 604, 606, 608 are discrete sections of a flexible material. For example, the first and second side walls 606, 608 may be obtained from a first continuous web 612 (FIG. 12) of flexible material, the front wall 602 may be obtained from a second continuous web 614 (FIG. 12) of flexible material, and the back wall 604 may be obtained from a third continuous web 616 (FIG. 12) of flexible material.

The flexible enclosure 600 includes a resealer on an interior surface of each of the walls 602, 604, 606, 608. To provide the resealers, each of the first, second, and third continuous webs 612, 614, 616 has a resealer applied thereto. For example, the first continuous web 612 may have a series of spaced-apart of resealers 661 applied along a width of the first folded segment. The resealers 661 extend in a direction that is transverse to the flow direction of the first continuous web 612. The second and third continuous webs 614, 616 may have resealers 662, 663, respectively, applied thereto in a direction that is parallel to the flow direction. The flexible enclosure 600 may be manufactured in a manner that is similar to the flexible enclosure 100.

As shown in FIG. 11, the flexible enclosure 600 has a plurality of resealers 661-663 that, as a group, extend entirely around or nearly entirely around an interior surface of the flexible enclosure 600. Each resealer may align with the other resealers such that an entire top portion of the enclosure may be removed. After opening, the flexible enclosure 600 may be closed by pressing the opposite front and back walls 602, 604 toward each other. For example, the resealers 662, 663 of the front and back walls 602, 604, respectively, may engage each other. The resealer 661 along the side wall 608 may engage itself and/or the resealer 661 along the side wall 606 may engage itself. Optionally, portions of the resealers 662, 663 of the front and back walls 602, 604 may engage the resealers 661 along the side walls.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are example embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose several embodiments of the inventive subject matter and also to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

As used herein, an element or step recited in the singular and proceeded with the word "a" or "an" should be understood as not excluding plural of said elements or steps, unless such exclusion is explicitly stated. Furthermore, references to "one embodiment" of the present inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

What is claimed is:

1. A flexible enclosure comprising:

a front wall and a back wall that oppose each other and a side wall that joins the front and back walls, wherein the front wall, the back wall, and the side wall are discrete sections, the front wall and the back wall being attached to opposite side edges of the side wall, the side wall having a slit between top edges and bottom edges of the front wall and the back wall to define a top wall portion of the side wall between the slit and the top edges of the front wall and the back wall and to define a bottom wall portion of the side wall between the slit and the bottom edges of the front wall and the back wall; and a resealer extending between the front and back walls along the bottom wall portion of the side wall, wherein the bottom wall portion is separable from the top wall portion along the slit, the bottom wall portion configured to flex outwardly and away from the top wall portion and form a spout of the flexible enclosure, the resealer configured to close the spout;

wherein the bottom wall portion is configured to flex outwardly and away from the top wall portion to form the spout and the resealer is configured to close the spout while the bottom wall portion is outwardly flexed away from the top wall portion, wherein the side wall is a first side wall and the flexible enclosure includes a second side wall that is also a discrete section with respect to the front wall, the back wall, and the first side wall, the front wall and the back wall being attached to opposite edges of the second side wall, the first and second side walls opposing each other, wherein the resealer is one of four resealers, each of the resealers extending along a respective one of the first side wall, the second side wall, the front wall, and the back wall.

2. The flexible enclosure of claim 1, wherein the side wall is configured to have a line of weakness, the slit being formed when the line of weakness is broken.

3. The flexible enclosure of claim 1, wherein the side wall is a gusseted side wall.

4. The flexible enclosure of claim 1, wherein the resealer includes a self-mating strip extending between the front and back walls along an interior surface of the side wall.

5. The flexible enclosure of claim 4, wherein the self-mating strip has opposite crushed ends and each edge of the side wall has one of the crushed ends.

6. The flexible enclosure of claim 1, wherein the resealer includes first and second segments that are configured to mate with one another to close the spout.

7. The flexible enclosure of claim 1, wherein the resealer is a first resealer and the second side wall has a second resealer that extends between the front and back walls, the second side wall configured to have a slit between top and bottom wall portions of the second side wall, wherein the second resealer extends between the front and back walls along the bottom wall portion of the second side wall, wherein the bottom wall portion of the second side wall is separable from the top wall portion along the slit, the bottom wall portion of the second side wall being configured to flex outwardly and away from the top wall portion, the resealer of the second side wall configured to close the second side wall.

8. The flexible enclosure of claim 7, wherein the front and back walls have respective slits and respective resealers and wherein the slits of the first and second side walls and the front and back walls enable a user to remove a top of the flexible enclosure to provide an open-ended enclosure having an open top, the resealers of the first and second side walls and the front and back walls enabling a user to close the open top of the open-ended enclosure.

9. The flexible enclosure of claim 1, wherein the top wall portion remains in a stationary position when the spout is in an open position and when the spout is in a closed position.

10. The flexible enclosure of claim 1, wherein the resealer is configured to close the spout while the top wall portion is positioned inwardly of the resealer.

11. A flexible enclosure comprising:

a front wall and a back wall that oppose each other and a first side wall that joins the front and back walls, wherein the front wall, the back wall, and the first side wall are discrete sections, the front wall and back wall being attached to opposite side edges of the first side wall, the first side wall having a first slit between top edges and bottom edges of the front wall and the back wall to define a top wall portion of the side wall between the first slit and the top edges of the front wall and the back wall and to define a bottom wall portion of the first side wall between the slit and the bottom edges of the front wall and the back wall;

a first resealer extending between the front and back walls along the bottom wall portion of the first side wall, wherein the bottom wall portion is separable from the top wall portion along the first slit, the bottom wall portion configured to flex outwardly and away from the top wall portion and form a spout of the flexible enclosure, the first resealer configured to close the spout;

wherein the bottom wall portion is configured to flex outwardly and away from the top wall portion to form the spout and the first resealer is configured to close the spout while the bottom wall portion is outwardly flexed away from the top wall portion; and a second side wall that is also a discrete section with respect to the front wall, the back wall, and the first side wall, the front wall and the back wall being attached to opposite edges of the second side wall, the first and second side walls opposing each other, the second side wall having a second resealer that extends between the front and back walls, the second side wall configured to have a second slit between top and bottom wall portions of the second side wall, wherein the second resealer extends between the front and back walls along the bottom wall portion of the second side wall, wherein the bottom wall portion of the second side wall is separable from the top wall portion along the second slit, the bottom wall portion of the second side wall being configured to flex outwardly and away from the top wall portion, the second resealer of the second side wall configured to close the second side wall.

12. The flexible enclosure of claim 11, wherein the first side wall is configured to have a line of weakness, the first slit being formed when the line of weakness is broken.

13. The flexible enclosure of claim 11, wherein the first side wall is a gusseted side wall.

14. The flexible enclosure of claim 11, wherein the first resealer includes a self-mating strip extending between the front and back walls along an interior surface of the first side wall.

15. The flexible enclosure of claim 14, wherein the self-mating strip has opposite crushed ends and each edge of the first side wall has one of the crushed ends.

16. The flexible enclosure of claim 11, wherein the first resealer includes first and second segments that are configured to mate with one another to close the spout.

17. The flexible enclosure of claim 11, wherein the front and back walls have respective third slits and respective third resealers and wherein the first and second slits of the first and second side walls and the third slits of the front and back walls enable a user to remove a top of the flexible enclosure to provide an open-ended enclosure having an open top, the first and second resealers of the first and second side walls and the front and back walls enabling a user to close the open top of the open-ended enclosure.

18. The flexible enclosure of claim 11, wherein the first resealer and the second resealer are two of four resealers, each of the resealers extending along a respective one of the first side wall, the second side wall, the front wall, and the back wall.

19. The flexible enclosure of claim 11, wherein the top wall portion remains in a stationary position when the spout is in an open position and when the spout is in a closed position.

20. The flexible enclosure of claim 11, wherein the first resealer is configured to close the spout while the top wall portion is positioned inwardly of the first resealer.

* * * * *